US007523885B2

(12) United States Patent
Lewis

(10) Patent No.: US 7,523,885 B2
(45) Date of Patent: Apr. 28, 2009

(54) HANDS-FREE ELECTRONIC TOWEL DISPENSER WITH POWER SAVING FEATURE

(75) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 105 days.

(21) Appl. No.: 11/759,391

(22) Filed: Jun. 7, 2007

(65) Prior Publication Data

US 2008/0100185 A1 May 1, 2008

Related U.S. Application Data

(60) Provisional application No. 60/855,707, filed on Oct. 31, 2006.

(51) Int. Cl.
*B65H 43/00* (2006.01)

(52) U.S. Cl. ..... 242/563; 250/221

(58) Field of Classification Search ..... 242/563, 242/563.2, 564, 564.1, 565; 250/221
See application file for complete search history.

(56) References Cited

U.S. PATENT DOCUMENTS

| | | | |
|---|---|---|---|
| 4,141,091 | A | 2/1979 | Pulvari |
| 4,516,020 | A | 5/1985 | Simpson et al. |
| 4,645,094 | A | 2/1987 | Acklin et al. |
| 4,666,099 | A | 5/1987 | Hoffman et al. |
| 4,786,005 | A | 11/1988 | Hoffman et al. |
| 4,872,485 | A | 10/1989 | Laverty, Jr. |
| 4,941,219 | A | 7/1990 | Van Marcke |
| 4,960,248 | A | 10/1990 | Bauer et al. |
| 4,972,070 | A | 11/1990 | Laverty, Jr. |
| 5,033,508 | A | 7/1991 | Laverty, Jr. |
| 5,086,526 | A | 2/1992 | Van Marcke |
| 5,452,832 | A | 9/1995 | Niada |
| 5,508,510 | A | 4/1996 | Laverty, Jr. et al. |
| 5,772,291 | A | 6/1998 | Byrd et al. |

(Continued)

FOREIGN PATENT DOCUMENTS

| | | | |
|---|---|---|---|
| DE | 4218658 | A1 | 12/1992 |

(Continued)

OTHER PUBLICATIONS

EPO Search Report, Jan. 23, 2008.

*Primary Examiner*—William A Rivera
(74) *Attorney, Agent, or Firm*—Dority & Manning, P.A.

(57) ABSTRACT

A hands-free towel dispenser for dispensing a measured sheet from a roll of towel material includes a housing having an internal volume so as to retain at least one roll of towel material therein. An electronically powered dispensing mechanism is contained within the housing for dispensing a measured sheet from the roll of towel material upon actuation of the dispensing mechanism. A passive trigger sensor is disposed so as to detect the presence of a user in a first detection zone, and an active dispense sensor is disposed so as to detect the presence of a user in a second detection zone that is different from the first detection zone. For each dispense cycle, the passive trigger sensor senses the presence of a user in the first detection zone prior to the active dispense sensor being enabled to initiate a dispense sequence upon detection of the user in the second detection zone.

23 Claims, 7 Drawing Sheets

U.S. PATENT DOCUMENTS

| | | | | |
|---|---|---|---|---|
| 5,943,712 | A | 8/1999 | Van Marcke | |
| 6,069,354 | A | 5/2000 | Alfano et al. | |
| 6,105,898 | A | 8/2000 | Byrd et al. | |
| 6,178,572 | B1 | 1/2001 | Van Marcke | |
| 6,293,486 | B1 | 9/2001 | Byrd et al. | |
| 6,412,655 | B1 | 7/2002 | Stuetzel et al. | |
| 6,695,246 | B1 | 2/2004 | Elliott et al. | |
| 6,838,887 | B2 * | 1/2005 | Denen et al. | |
| 6,854,684 | B2 | 2/2005 | Byrd et al. | |
| 7,398,944 | B2 * | 7/2008 | Lewis et al. | 242/563 |
| 2004/0035976 | A1 | 2/2004 | Byrd et al. | |
| 2004/0135027 | A1 | 7/2004 | Elliott et al. | |
| 2004/0178297 | A1 * | 9/2004 | Moody et al. | 242/564.4 |
| 2005/0077419 | A1 * | 4/2005 | Thomas et al. | 242/563 |
| 2006/0163416 | A1 | 7/2006 | Byrd et al. | |
| 2006/0169827 | A1 | 8/2006 | Lewis et al. | |

FOREIGN PATENT DOCUMENTS

| | | | |
|---|---|---|---|
| EP | 0078181 | A1 | 5/1983 |
| EP | 0341757 | A | 11/1989 |
| EP | 1414154 | A1 | 4/2004 |

* cited by examiner

HANDS-FREE ELECTRONIC TOWEL DISPENSER WITH POWER SAVING FEATURE

PRIORITY CLAIM

The present application claims priority to Provisional Application Ser. No. 60/855,707, filed Oct. 31, 2006.

FIELD OF THE INVENTION

The present invention relates generally to the field of dispensers for dispensing lengths of towel material from a roll, and more particularly to "hands-free" electronic dispensers that automatically dispense a measured length of towel material upon sensing the presence of a user.

BACKGROUND OF THE INVENTION

Electronic towel dispensers are well know in the art, including dispensers that automatically dispense a metered length of towel material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied.

Electronic dispensers are known that use a passive detection system to initiate a dispense sequence upon detection of a user. For example, U.S. Pat. No. 5,772,291 describes an electronic hands-free towel dispenser that utilizes a photo sensor to detect the presence of a user through the front cover of the housing. The photo sensor and associated control circuitry activate a motor to dispense a predetermined length of towel web material upon detecting the user. The photo sensor reacts to changes in a room's ambient light intensity, and when a person places an object, such as their hand, within a predetermined distance (detection range) of the front of the dispenser, the amount of ambient light reaching the photo sensor is decreased sufficiently to cause the photo sensor and control circuitry to register a "detect" and initiate a dispense cycle.

Similarly, U.S. Pat. No. 5,452,832 describes an automatic paper towel dispenser wherein a photocell detector disposed on the side of the dispenser actuates an on-off switch for supplying power to a drive motor for a specified time period to dispense a length of paper towel.

Another type of passive detection system is described in U.S. Pat. No. 6,412,655 as an electronic towel dispenser that utilizes a capacitive sensor on the front of the dispenser housing. The sensor includes electrodes disposed behind a sensor field in the cover that may cover the entire width of the housing. The electrodes establish a dielectric having a defined capacitance in the idle state. If there is a change in the dielectric caused by a user placing their hand in front of the dispenser housing, a change in the capacitance results and triggers a dispensing sequence.

Active detection systems are also widely used in electronic towel dispensers, and generally include an active transmitter and receiver combination to detect the presence of a user within an active detection zone. Typical systems may include radio frequency (RF), infrared (IR) sensors, or the like. For example, U.S. Pat. No. 6,695,246 describes an electronic dispenser utilizing an active IR sensing system.

Many electronic towel dispensers rely on battery power as a primary power source. Accordingly, conservation of battery power is an important concern. In this regard, the passive detection systems are generally recognized as desirable from the aspect of energy conservation in that they consume less battery power than the transmitter/receiver components of the active sensing systems. However, the passive systems may not be as reliable as the active systems and can be prone to false detections, which leads to waste of web material and loss of confidence in the dispenser. In this regard, efforts have been made to reduce the consumption of battery power in dispensers utilizing active sensing systems. For example, the dispenser according to U.S. Pat. No. 6,695,246 utilizes solar panels to recharge the battery. Further, the control circuitry utilizes an oscillator circuit to turn power to the microprocessor on and off at a predetermined frequency to reduce power consumption by the microprocessor.

The art is thus constantly seeking ways to improve upon conventional hands-free towel dispensers. The present invention relates to such an improvement.

OBJECTS AND SUMMARY OF THE INVENTION

Objects and advantages of the invention will be set forth in part in the following description, or may be obvious from the description, or may be learned through practice of the invention.

An electronic hands-free towel dispenser is provided for automatically dispensing a measured sheet of web material upon detection of an object placed within a defined detection zone. The dispenser may be battery powered, AC powered (with an appropriate transformer and adapter), or capable of being switched between battery power and AC power. The dispenser incorporates unique features to conserve battery power and limit web material waste.

The dispenser includes a housing having an internal volume so as to retain at least one roll of towel material therein. In a particular embodiment, the housing is configured to retain a primary reserve roll and a depleted stub roll. The housing may take on any desirable and aesthetically pleasing configuration, and may include a back member and removable cover member. The cover member may be hinged relative to the back member to provide access to the interior volume and components of the dispenser.

The dispenser includes an electronically powered dispensing mechanism contained within the housing for automatically dispensing the measured sheet from the roll of towel material upon a valid detection of an object in the detection zone. Numerous configurations of electrically driven dispensing mechanisms are known in the art and may be configured for use with the present dispenser. In a particular embodiment, a separate chassis or module is received in the housing, the module having the dispensing mechanism mounted therein. The mechanism may include a drive roller and associated components, a pressure roll assembly, and a tear bar. The pressure roll assembly includes a pressure roll biased against the drive roller, the towel material passing between the pressure roll and drive roller. An opening for the towel material is defined in the module and aligns with a dispensing opening in the housing.

In an embodiment wherein the dispenser dispenses from a stub roll and subsequently from a reserve or "main" roll, the chassis may include main roll holders and stub roll holders for rotatably supporting the respective rolls in a position within the module for unobstructed dispensing therefrom. An automatic transfer mechanism is provided to transfer dispensed towel material from the stub roll to the main roll when the stub roll is nearly fully depleted.

A roll-size ("fuel") gauge may be configured in the module to indicate to service or maintenance personnel when the main roll has been depleted a sufficient amount to be moved to the stub roll position. This gauge may be a member that is biased against the outer circumferential surface of the main roll such that it tracks with the decreasing diameter of the main roll as the web material is depleted. When the main roll reaches a certain depleted diameter, the gauge may activate a switch causing an LED to light, or other indicator, to indicate that the main roll is depleted and should be replaced. Alternatively, the indicator may be a mechanical type, such as a flag that becomes visible upon the diameter of the main roll being sufficiently reduced.

The dispensing mechanism dispenses a measured length or sheet of the web material, which may be accomplished by various means, such as a timing circuit that stops the drive roller after a predetermined time. In a particular embodiment, a revolution counter is provided that measures the degree of rotation of the drive roller and is interfaced with control circuitry to stop a drive roller motor after a defined number of revolutions of the roller. This counter may be an optical encoder type of device, or a mechanical device. The control circuitry may include a device to allow maintenance personnel to adjust the sheet length by increasing or decreasing the revolution counter set point.

The drive mechanism may include a drive motor and gear assembly mounted in the module, the gear assembly transmitting motive force from the motor to the drive roller. The web material passes through the nip defined by the drive roller and pressure roller such that rotation of the drive roller causes the material to be advanced out through the dispensing throat of the housing. A tear bar is disposed in the throat so that a user can separate a sheet of the material by grasping and pulling the sheet across the tear bar. In an alternative embodiment, an automatic cutting device may be provided to automatically cut the sheet of material.

The dispenser utilizes a combination of a passive trigger sensor disposed so as to detect the presence of a user in a first detection zone, and an active dispense sensor disposed so as to detect the presence of a user in a second detection zone to initiate a dispense sequence. The passive trigger sensor and active dispense sensor are configured with the dispenser's control circuitry so that, for each dispense cycle, the passive trigger sensor must first sense the presence of a user in the first detection zone prior to the active dispense sensor being enabled to initiate a dispense sequence upon active detection of the user in the second detection zone.

The passive trigger sensor may be any one or combination or well-known passive sensing systems, such as a photo sensor that detects changes in ambient light conditions, a capacitive sensor, and so forth. Similarly, the active dispense sensor may be any one or combination of well-known active sensing systems, such as an IR or RF system that actively transmits a signal into a detection zone and receives a return signal that indicates that an object is within the detection zone. In a particular embodiment, the passive trigger sensor utilizes a photo sensor that detects changes in ambient light conditions within the first detection zone, and the active dispense sensor is an IR transmitter/sensor configuration that detects the presence of the user in the second detection zone.

In a particular embodiment, the passive trigger sensor must reset to a base state indicating the absence of a user in the first detection zone before the active dispense sensor is enabled for a subsequent dispense sequence. This particular configuration minimizes waste of the web material in that it prevents a user from standing in front of the dispenser and initiating multiple sequential dispense operations. The user must exit the area of the first detection zone prior to a subsequent dispense sequence.

In an alternate embodiment, the control circuitry defines a pre-set time period between dispense sequences, which may be adjusted by maintenance personnel. This feature may be in addition to the requirement that the passive trigger sensor must be reset to a base state. For example, a time period of three seconds may be required after the passive trigger sensor has been reset. In a different embodiment wherein the passive trigger sensor need not be reset to a base state, the time period may apply only to sequential activations of the active dispense sensor. For example, a user may stand in front of the dispenser so that the passive trigger sensor sees a continual "valid" detection. However, the time period must pass between sequential detections of the active dispense sensor. The time period may be set sufficiently long so as to discourage waste.

In certain embodiments, the passive trigger sensor is oriented so that the first detection zone is defined adjacent to a front side of the dispenser housing, and the active dispense sensor is oriented so that the second detection zone is defined at a different location, for example below a bottom surface of the housing. With this configuration, a user must not only be in front of the dispenser, but must also purposefully place their hands below the dispenser to initiate a dispense sequence. Thus, the dispenser is not falsely activated by a person or object merely passing adjacent to the dispenser. This minimizes waste of the web material, particularly in relatively small public restrooms where conventional passive dispensers are prone to being actuated by opening of the restroom door, or persons entering or leaving the facility.

The dispenser housing may include a dispensing throat in a bottom portion thereof through which the web material is dispensed, with the active dispense sensor comprising at least one active transmitter and a receiver oriented within the housing adjacent to the dispensing throat to transmit an active signal in a transmission zone that defines the second detection zone below the housing. The active transmitter and receiver may be oriented with respect to the throat such that a sheet of the web material hanging out of the dispensing throat disrupts detection of an object within the detection zone. Thus, a sheet that is dispensed for one user but left hanging from the dispenser must be removed by a subsequent user before the system is enabled for a subsequent dispense sequence.

The dispenser may include a "night sensor", such as an ambient light sensor, configured with the control circuitry as a low-light sensor that shifts the dispenser to a reduced power mode in low-light conditions. The passive trigger sensor and active dispense sensor are disabled in the low-light conditions. This ambient light sensor may be disposed so as to detect ambient light conditions in an area different from the first and second detection zones, for example the area above the housing.

It should be appreciated that the dispenser is not limited to any particular style, configuration, or intended type of web material. For example, the dispenser may be a towel dispenser, toilet tissue dispenser, or any other sheet material dispenser.

Various methods for operation of an electronic dispenser incorporating a passive trigger sensor and an active dispense sensor are also within the scope and spirit of the invention, and may include detecting the presence of a user in a first detection zone with the passive sensor and subsequently detecting the presence of the user in a second detection zone with the active sensor wherein, for each dispense cycle, the passive sensor must sense the presence of a user in the first detection zone prior to the active sensor detecting the presence of the user in the second diction zone to initiate a dispense sequence.

The invention will be described in greater detail below by reference to particular embodiments illustrated in the drawings.

DETAILED DESCRIPTION

Figure 1:
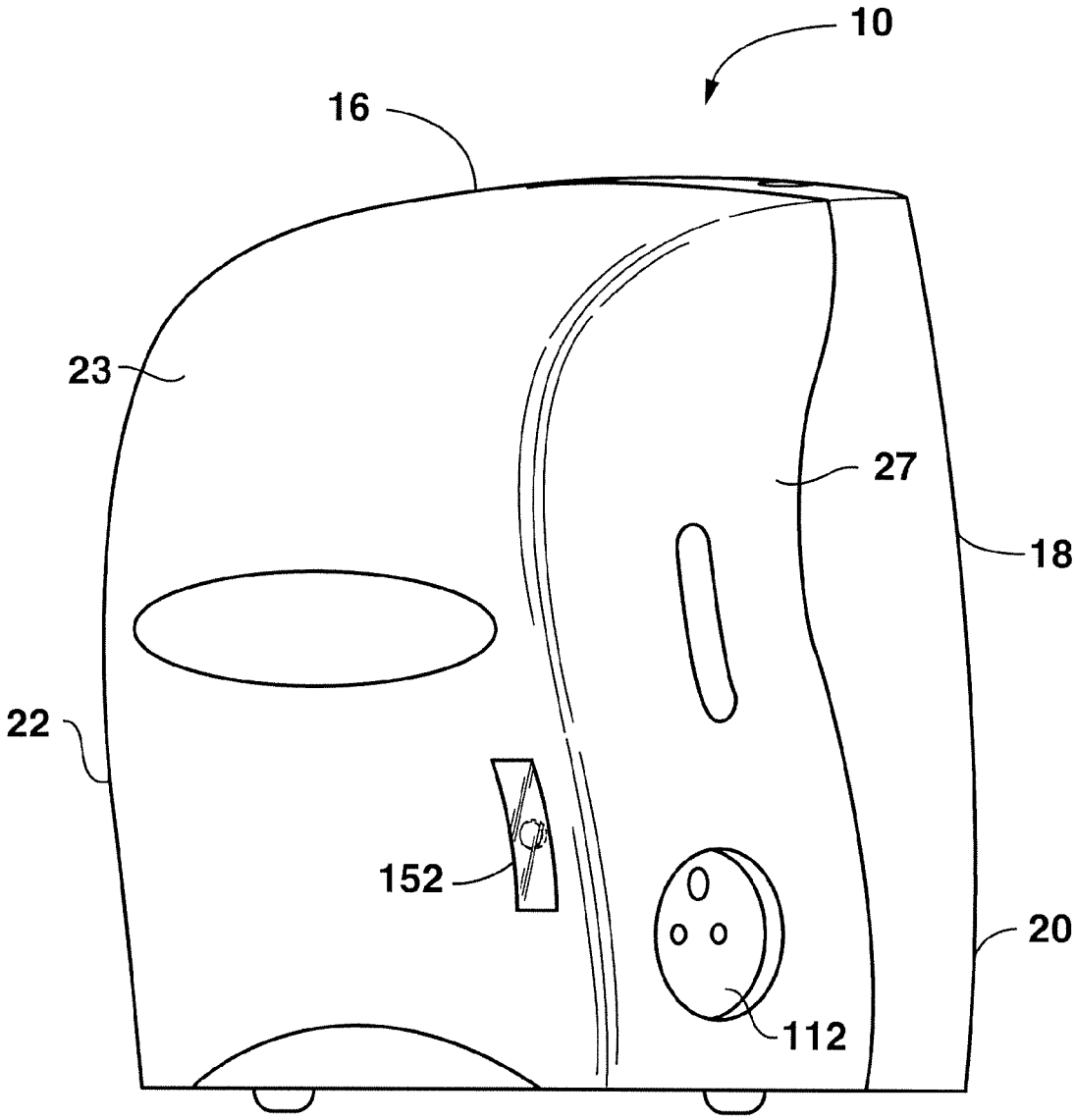
FIG. 1 is a perspective view of an embodiment of an electronic dispenser according to the invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

Figure 2:
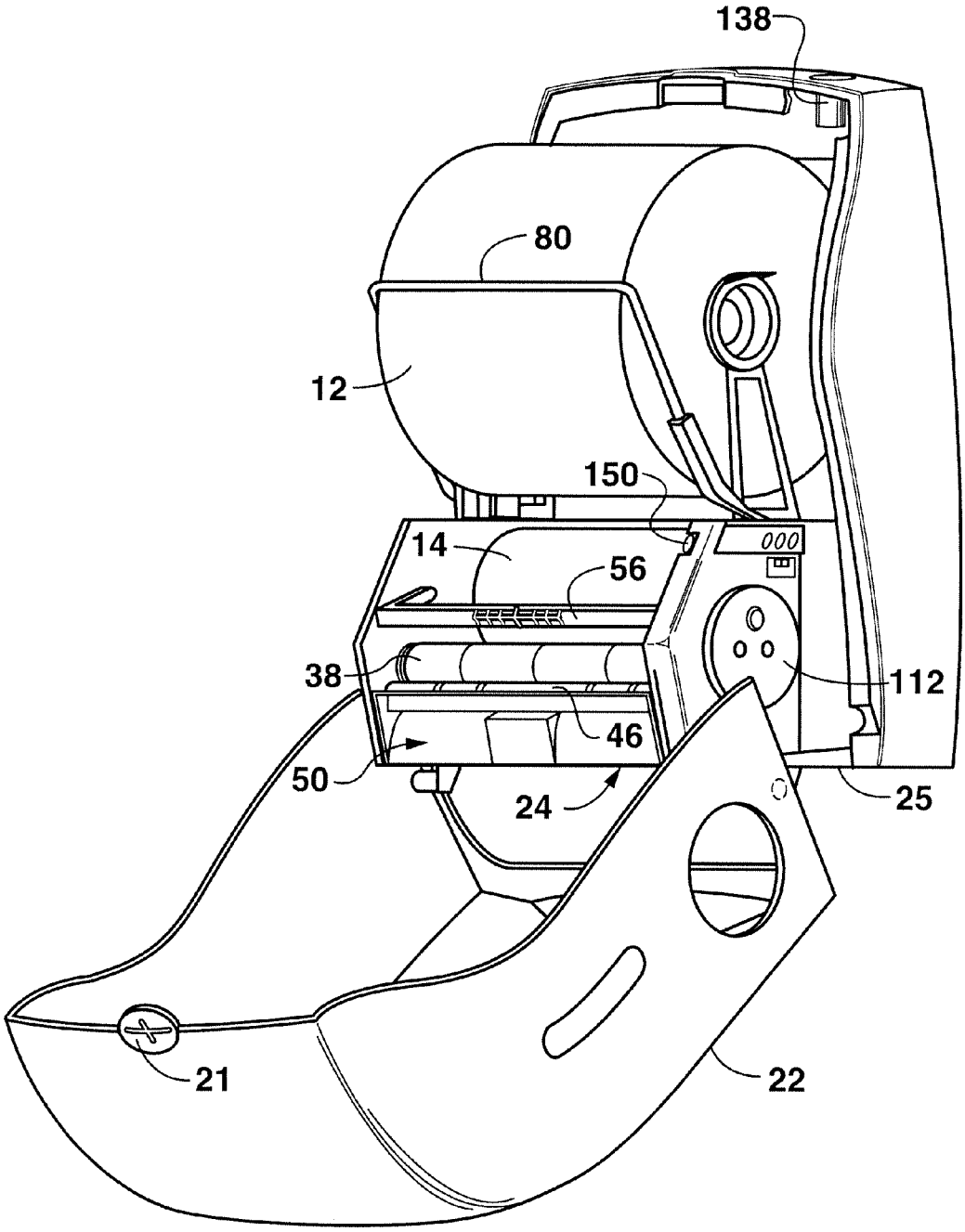
FIG. 2 is a perspective view of the dispenser of FIG. 1 with the front cover in its open position.
Figure 3:
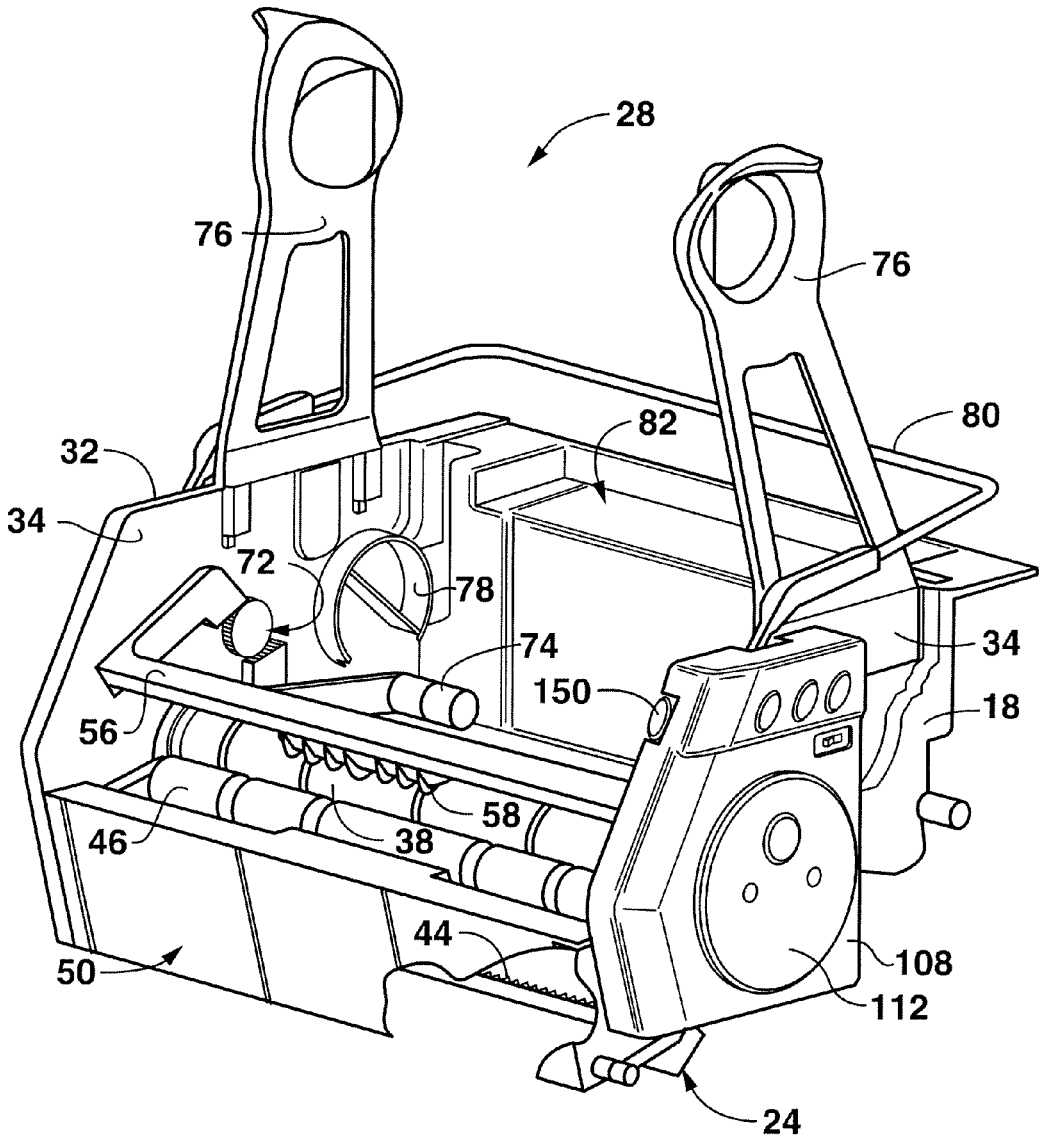
FIG. 3 is a perspective view of a removable module unit that may be utilized with the dispenser of FIG. 1.

Referring particularly to FIGS. 1 through 3, an embodiment of a dispenser 10 according to the invention is illustrated. The dispenser 10 includes a housing 16 of any desired shape and configuration. The housing 16 includes a base 18 and a cover 22 pivotally mounted on the base 18 so as to be movable from the closed position illustrated in FIG. 1 to the open position illustrated in FIG. 2. The cover 22 includes a front wall 23 and sidewalls 27 that align with sidewalls 20 of the base 18 to define an interior volume for housing the operational components of the dispenser 10, as well as the roll or rolls of web material to be dispensed, including a main roll 12 and a stub roll 14. Any conventional locking mechanism 21 (FIG. 2) may be provided to secure the cover 22 to the base 18. The housing 16 includes a bottom underside portion 25 with a throat (not visible) from which the material is dispensed.

The dispenser configuration 10 illustrated in FIGS. 1 and 2 is merely exemplary of any number of electronic dispenser configurations known to those skilled in the art that may incorporate the power saving features and method in accordance with the invention. As such, a detailed explanation of the structural and control features of the dispenser 10 are not necessary for purposes of explanation of the system and method of the invention, and will only be discussed briefly below.

The operational components of the dispenser 10 may be mounted directly onto the base 18 within the interior volume of the housing 16. In an alternative embodiment, a dispensing module 28 (FIG. 3) is received in the housing 16, as seen in FIG. 2, and the operational components are mounted within the module 28. The module 28 may be readily removable from the base 18 for servicing and/or replacing components without the necessity of having to remove the entire dispenser 10 from its support surface (i.e., wall). The housing 16 may be considered as a shell into which the module 28 of FIG. 3 is inserted and removed. The module 28 includes a frame or chassis 32 having left and right side plates 34. Within the module 28 between the side plates 34 are mounted the components of the dispensing mechanism 30, which may include, for example, a pressure roller assembly with a pressure roller 46, a transfer mechanism that may include a transfer arm 56, a throat assembly 50 that defines the throat 24 and includes a tear bar 44, a drive motor and gear assembly (not visible) that rotates drive roller 38, and control circuitry housed within a circuit housing 108.

Figure 4:
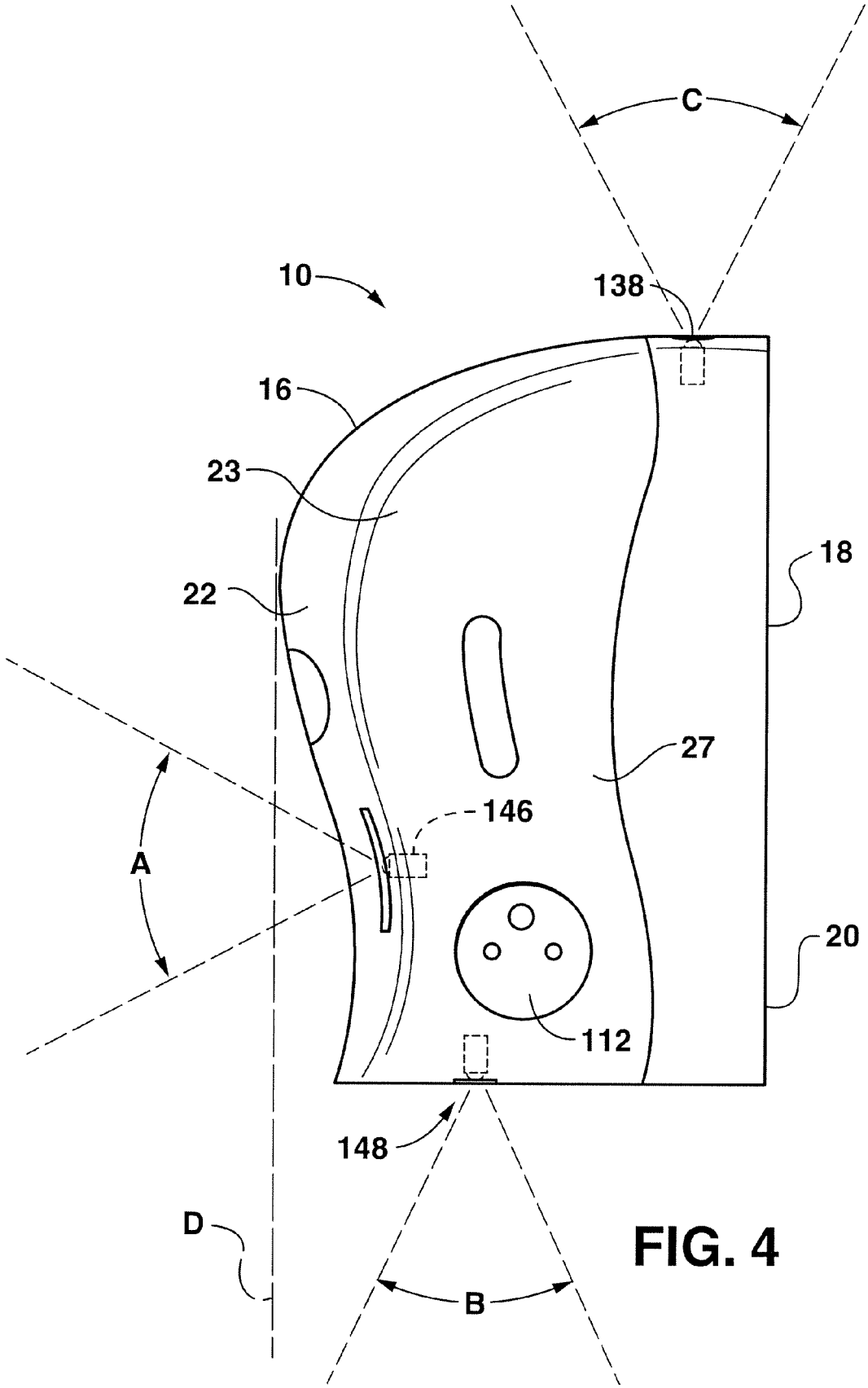
FIG. 4 is a side perspective view depicting the orientation of the active dispense sensor and passive trigger sensor, and associated detection zones, as well as an ambient light detector.

Left and right main roll holders 76 are attached to the module side plates 34, as seen in FIG. 4, and hold the main roll 12 of sheet material. Stub roll holders 78 are provided for rotatably supporting the stub roll 14 in the position within the module below and rearward of the main roll 12. It should be understood that a dispenser according to the invention need not be configured to dispense from a stub roll, and thus would not need a transfer mechanism. The dispenser may be configured for dispensing from a single roll of web material.

The pressure roller assembly with pressure roller 46 may be housed in the throat assembly 50 that is, in turn, mounted within the module 28. The throat assembly 50 includes a frame that may be fixed in position within the module, or pivotally mounted to the module 28 to facilitate loading of new rolls of web material. The cutting or "tear" bar 44 within the throat assembly 50 is disposed along the dispensing path of the web material upstream of the dispensing opening 24 and downstream of the nip between a drive roller 38 and pressure roller 46. To separate a sheet of the web material that has been dispensed from the dispenser 10, a user grasps the sheet hanging from beneath the bottom portion 25 of the housing 16 and pulls the sheet against the tear bar 44 such that the sheet tears and separates along the line defined by the tear bar 44.

The pressure roller 46 is spring biased against the drive roller 38 such that the web material passing between the nip of the rollers is advanced along the dispensing path upon rotation of the drive roller 38. The throat assembly 50 defines a portion of the dispensing path and the forward portion of the dispensing throat 24.

The module 28 may include an automatic transfer mechanism to transfer dispensing of the web material from the stub roll 14 to a main roll 12 when the web material on the stub roll 14 is nearly fully depleted. From an operational standpoint, this transfer mechanism can operate substantially as described in U.S. Pat. No. 6,079,305 issued on Jun. 27, 2000, with the '305 patent incorporated herein in its entirety for all purposes. Referring to FIGS. 2 and 3, the transfer mechanism may include a transfer bar 56 with arms pivotally mounted to the module side plates 34 through gearing 72. The transfer bar 56 includes a "roller" section that may be defined by a central curved ribbed section 58. The section 58 includes a securing mechanism, such as a barb, so that the leading end of the web material from the main roll 12 passes over the roller section 58 and is held by the barb while material is feed from the stub roll 14. A stub roll sensing bar 74 is pivotally mounted to the module side plates 34 below stub roll holders 78, and is biased towards the axis of the stub roll holders 78 so as to track the decreasing diameter of the stub roll as it is depleted. The stub roll sensing bar 74 is configured with the gearing 72 that rotates upon pivotal movement of the sensing bar 74. As the stub roll is depleted, motion of the sensing bar 74 is transferred to the transfer bar 56 via the gearing 72. At a certain decreased diameter of the stub roll 14, the transfer bar 56 rotates to a position such that the leading end of the web material held by the bar 56 is brought by the roller section 58 into contact with the web material being dispensed from the stub roll causing the leading edge of the material from the main roll to be pulled from the arm 56 and conveyed with the material from the stub roll between the nip of the drive roller 38 and pressure roller 46. The "new" web material from the main roll 12 is dispensed simultaneously with the stub roll material until the stub roll is completely depleted. If no stub roll is present in the dispenser, the transfer bar 56 and roller section 58 contact against the web material dispensed from the main roll 12.

A spring biased "fuel gauge" bar 80 may be pivotally affixed to the side plates 34 and biased towards the center of the main roll 12 such that it tracks with the decreasing diameter of the main roll 12 as the web material is depleted. This bar 80 may be biased against the front side (as depicted in the figures) or the rear side of the main roll 12. When the main roll 12 reaches a diameter suitable for moving the roll to the stub roll position, a pawl (not visible) on the end of one of the arms of the bar 80 causes a switch in the control circuitry to close and activate an LED on the indicator plate 112. In this way, maintenance personnel are alerted that the main roll 12 is depleted and should be replaced.

A drive motor and gear assembly includes components mounted in the module 28, for example in a space under and behind the drive roller 38. The motor includes a drive shaft and a drive gear attached thereto that engages the shaft of the drive roller 38. Thus, upon energizing the motor, the drive roller 38 is caused to rotate, which results in conveyance of the web material disposed in the nip between the pressure roller 46 and drive roller 38 along the conveying path and out of the dispensing throat 24.

The dispensing mechanism may be powered by batteries contained in battery compartment 82 that is rearward of the stub roll holders 76 (see FIG. 3). Any suitable battery storage device or location may be used for this purpose. A conductor may be disposed below the battery compartment that mates with contacts on the underside of the battery compartment 82 for delivering power from the batteries to the circuitry in housing 108 and the drive motor. Alternatively, or in addition to battery power, the dispenser may also be powered by a building's AC distribution system. For this purpose, a plug-in modular transformer/adapter may be provided with the dispenser, which connects to a terminal or power jack port located, for example, in the bottom edge of the circuit housing 108 for delivering power to the control circuitry and associated components. The control circuitry may include a mechanical or electrical switch that isolates the battery circuit upon connecting the AC adapter in order to protect and preserve the batteries.

The control circuitry also controls the length of web material dispensed. Any number of optical or mechanical devices may be used in this regard. In the illustrated embodiment of the dispenser 10, an optical encoder may be used to count the revolutions of the drive roller 38, with this count is used by the control circuitry to meter the desired length of the sheet to be dispensed. Other systems may track the running time of the motor as the control variable, or detect perforations in the web material, and so forth.

Referring to FIG. 4, the dispenser 10 utilizes a combination of a passive trigger sensor 146 disposed so as to detect the presence of a user in a first detection zone A, and an active dispense sensor 148 disposed so as to detect the presence of a user in a second detection zone B to initiate a dispense sequence. In the illustrated embodiment, the passive trigger sensor 146 is disposed within the dispenser housing so as to look through the front wall 23 of the cover 22. The respective detection zone A for the passive trigger sensor 146 is thus oriented in front of the dispenser housing 16.

Referring to FIGS. 1 through 3, the passive trigger sensor 146 in the illustrated embodiment includes a photo sensor 150 mounted on one of the sidewalls 34 of the module 28. The photo sensor 150 may be any one or combination of conventional photocells that react to changes in ambient light conditions. The operation of such devices are well known to those skilled in the art and need not be described in detail herein. A viewing window 152, such as a clear shield, may be provided in the front wall 23 of the dispenser cover 22 through which the sensor 150 "looks" out through the cover, as depicted in FIG. 1.

It should be appreciated that the passive trigger sensor 146 may be any manner of well-known passive sensing devices, such as a capacitive sensor system that detects changes in a capacitive filed induced by the presence of a user within the monitored field.

The active dispense sensor 148 is depicted in the illustrated embodiments as one or more active transmitters 122 and associated receiver 124 that define an active detection zone B. This active system may be any one or combination of well-known active sensing systems, such as an RF or IR sensing system. In a particular embodiment, the active dispense sensor 148 includes dual active IR transmitters 122 and an IR receiver 124. The active transmitters 122 emit an IR beam into the detection zone B, and the receiver 124 detects IR light reflected from an object in the detection zone B. If the amount of reflected light is sufficient (above a detection threshold value), the circuitry controller initiates a dispense cycle wherein the motor 100 drives the drive roller 38 until the predetermined number of pulses are detected by the optical encoder (drive roller revolution counter) indicating that the correct length of material has been dispensed. The user then grasps the dispensed sheet and pulls it forward to tear the sheet against the tear bar 44.

Figure 5A:
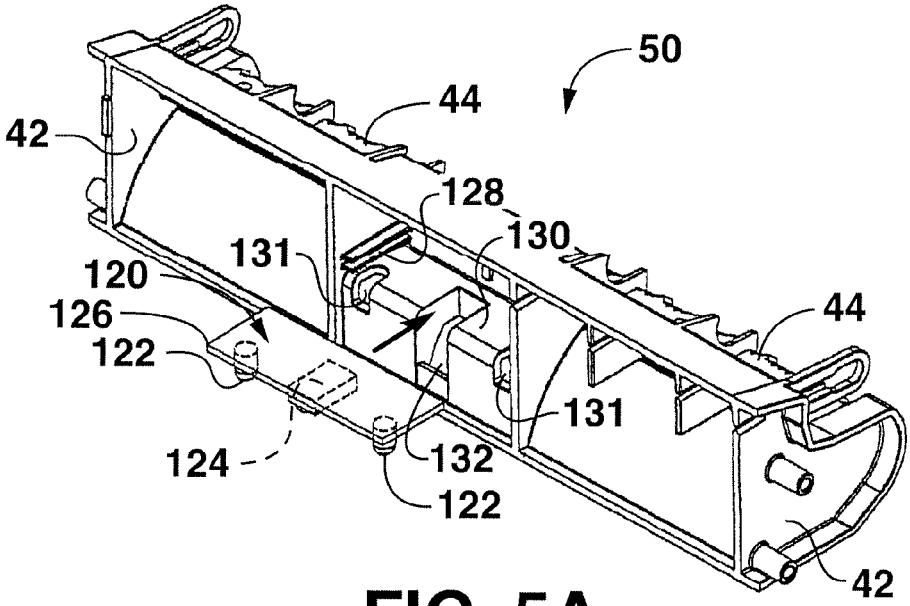
FIGS. 5A through 5C are perspective component views of an embodiment of an active transmitter/receiver configuration that may be utilized in a dispenser according to the invention.
Figure 5B:
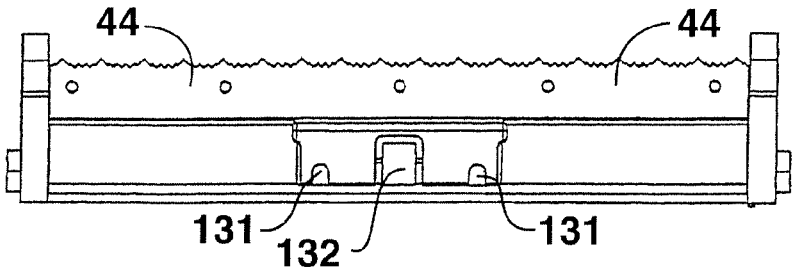
Figure 5C:
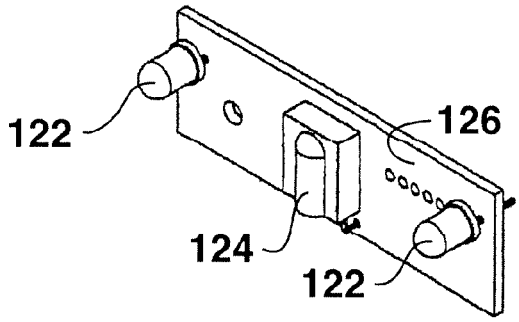

Referring particularly to FIGS. 5A through 5C, the active IR transmitters 122 and receiver 124 are mounted on a sensor board 126. The board 126 is inserted into board slots 128 defined within a board housing 130 on the middle underside of the throat assembly 50, as particularly seen in FIG. 5A. Openings 131 are defined in the housing 130 through which the transmitters 122 actively transmit. An opening 132 is provided in the housing 130 for the receiver 124. The transmitters 122 and receiver 124 are in electrical communication with the control circuitry within the circuit housing 108, and the transmitters 122 continuously transmit at a pulse rate that is dictated by the control circuitry, particularly by a microprocessor (FIG. 7), as discussed in greater detail below.

Figure 6:
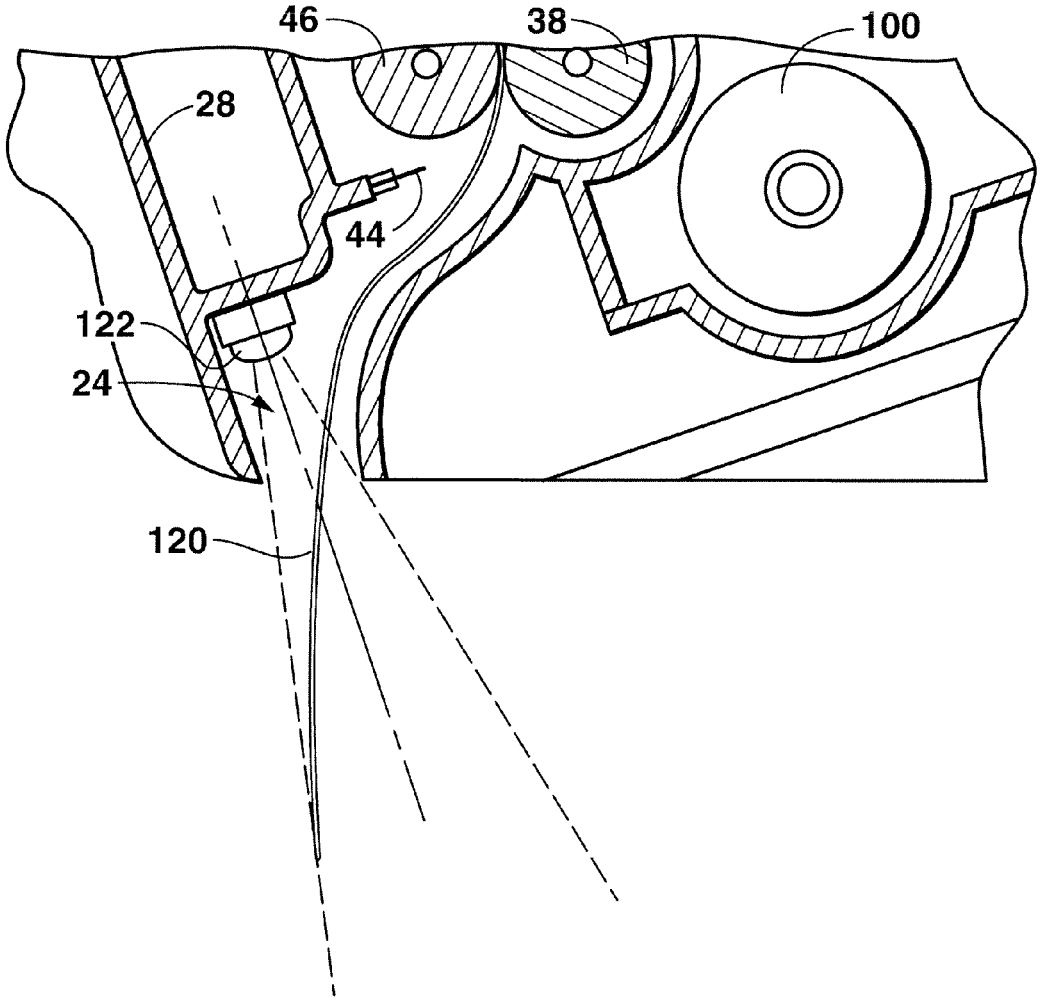
FIG. 6 is a side diagrammatic view illustrating aspects of an active sensor and associated detection zone under the dispenser housing.

FIG. 6 illustrates the location and angular orientation of the IR transmitters 122 within the throat assembly 50. The transmitters 122 are mounted adjacent the forward (front) wall of the dispensing throat 24 and are oriented (angled) towards the rear of the dispenser at an angle of with respect to vertical. This angle may be, for example, 15°. The transmitters 122 have a relatively narrow transmission cone of, for example, 40° (20° on each side of the transmitter axis). The angular orientation and transmission cone are designed such that the effective detection zone B (FIG. 4) does not extend forward of plane D up to the maximum effective range (sensitivity) of the transmitters. The plane D corresponds to the vertical plane of the front cover 22 of the dispenser. With this configuration, a user must purposefully place their hand or other object below the housing 16 and towards the back of the housing 16 in order to be "detected" and initiate a dispensing cycle.

It may also be desirable to provide the dispenser 10 with the capability to prevent a subsequent dispensing cycle if a sheet of material has been dispensed but not removed. A separate "hanging sheet" detector may be provided and integrated with the control circuitry for this purpose. However, in the illustrated embodiment, the IR detection sensor configuration also serves this purpose. Referring to FIG. 6, a hanging sheet of material is represented by the line 200. This sheet 200 is at a position such that it essentially blocks transmission of the active IR signal from the transmitters 122 into the detection zone B. The web material itself does not adequately reflect the IR signal to the receiver 124, and the hanging sheet does not generate a valid detection signal. Thus, an object placed into the detection zone B while a sheet 200 is left hanging from the dispensing throat 24 is not likely to cause a subsequent dispensing cycle until the hanging sheet has been removed, or is purposefully pushed out of the detection zone B.

The passive trigger sensor 146 and active dispense sensor 148 are configured with the dispenser's control circuitry so that, for each dispense cycle, the passive trigger sensor 146 must first sense the presence of a user in the first detection zone A prior to the active dispense sensor 148 being enabled to initiate a dispense sequence upon active detection of the user in the second detection zone B. In a particular embodiment, the passive trigger sensor 146 must reset to a base state indicating the absence of a user in the first detection zone A before the active dispense sensor 148 is enabled for a subsequent dispense sequence. A logic circuit may be utilized within the control circuitry to enable this feature. This particular configuration minimizes waste of the web material in that it prevents a user from standing in front of the dispenser and initiating multiple sequential dispense operations. The user must exit the area of the first detection zone A prior to a subsequent dispense sequence.

In an alternate embodiment, the control circuitry may define a pre-set time period between dispense sequences. This time period may be adjusted by maintenance personnel. This feature may be in addition to the requirement that the passive trigger sensor 146 must be reset to a base state. For example, a time period of three seconds may be required after the passive trigger sensor 146 has been reset.

In a different embodiment wherein the passive trigger sensor 146 need not be reset to a base state, the time period may apply only to sequential activations of the active dispense sensor 148. For example, a user may stand in front of the dispenser so that the passive trigger sensor sees a continual "valid" detection. However, the time period must pass between sequential detections of the active dispense sensor 148. The time period may be set sufficiently long so as to discourage waste.

The dispenser 10 may include a "night sensor", such as an ambient light sensor, configured with the control circuitry as a low-light sensor that shifts the dispenser to a reduced power mode in low-light conditions. In the illustrated embodiment, a photocell 138 is configured within the dispenser housing 16 so as to "look" through the housing towards a zone C above the dispenser housing, as depicted in FIG. 4. The passive trigger sensor 146 and active dispense sensor 148 are disabled by the control circuitry in the low-light conditions. It certain situations, the ambient light detector function may not be desired. For this reason, a bypass switch may be provided and accessible externally of the circuit housing 108 such that maintenance personnel may bypass and deactivate the ambient light-sensing feature.

Figure 7:
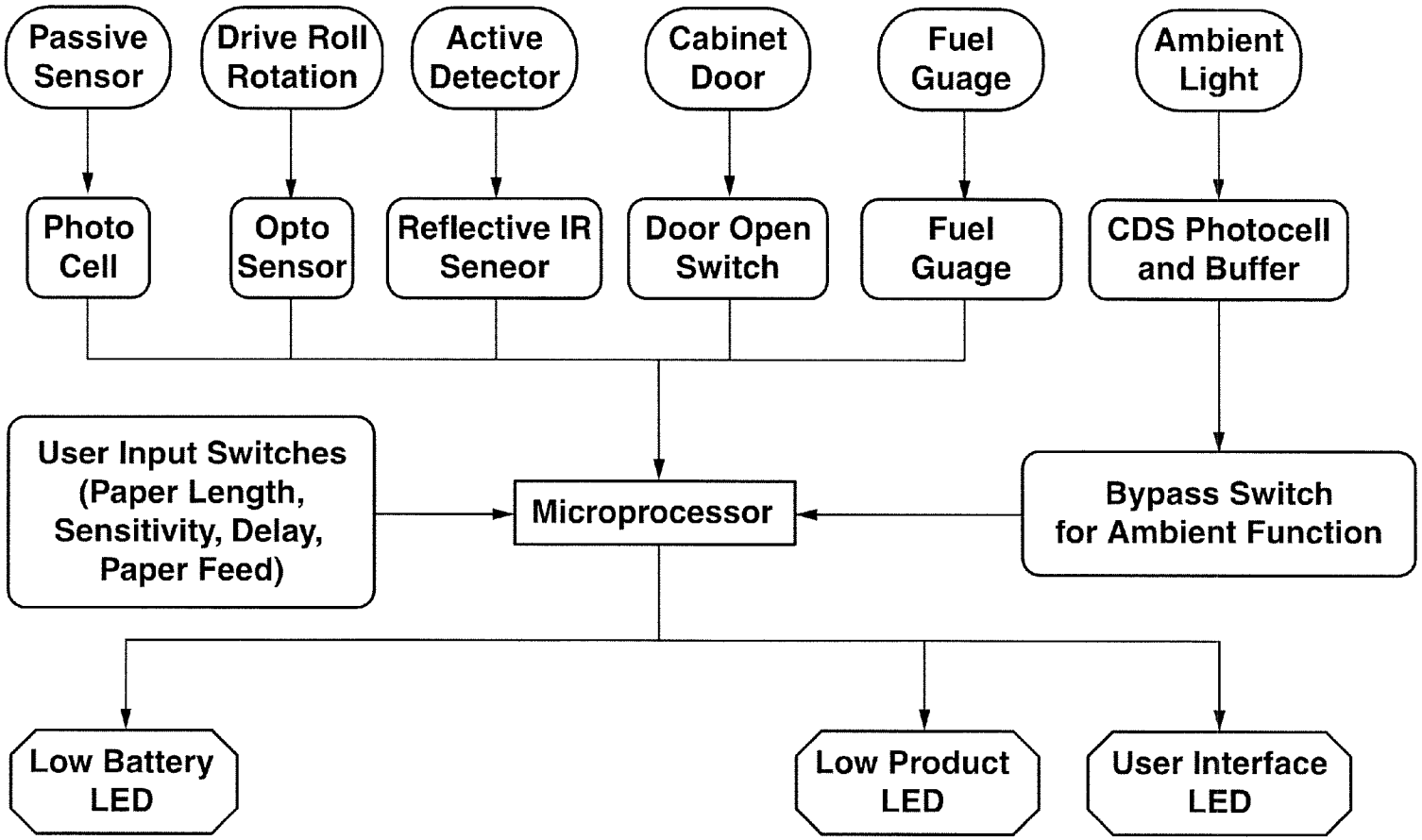
FIG. 7 is a block diagram illustrating an embodiment of aspects of control circuitry that may be used with the dispenser according to the invention.

FIG. 7 is a functional block diagram of an embodiment of control circuitry that may be used with the dispenser 10. It should be appreciated that various control circuits and component arrays may be configured by those skilled in the art to accomplish the desired features of the dispenser 10, and that the circuit described herein is but one embodiment of suitable circuitry. Referring to FIG. 7, the circuit is controlled by a microprocessor, with various inputs and outputs as indicated and discussed above. Switches are indicated in the figure for control features that may be varied, such as the length of sheet material dispensed, the sensitivity of the active dispense sensor, the time delay between dispense cycles, a manual paper feed, and so forth. These switches are generally configured with the control circuitry within housing 108 and only accessible to maintenance personnel upon removing front cover 22 of the housing.

Various LED indicators on the indicator plate 112 are also depicted in FIG. 7. These indicators may be used for any purpose, such as an indication of low battery power, or a low web material condition as sensed by the bar 80 (FIG. 3) and associated switch.

A cabinet door switch may be provided, as indicated in FIG. 7, that disables the dispensing mechanism in the event that the dispenser cover 22 is in the open position. Thus, maintenance personnel may open the cover 22 to replace the web rolls or other service without initiating a dispense sequence.

It should be appreciated by those skilled in the art that various modifications and variations may be made to features of the dispenser described herein, particularly to the mechanical and control circuitry aspects of the dispenser, without departing from the scope and spirit of the invention. It is intended that the invention include all such variations.

What is claimed is:

1. A hands-free towel dispenser for dispensing a measured sheet from a roll of web material, comprising:

a housing having an internal volume so as to retain at least one roll of towel material therein;

an electronically powered dispensing mechanism contained within said housing for dispensing a measured sheet from the roll of web material in a dispense cycle upon actuation of said dispensing mechanism;

a passive trigger sensor disposed so as to detect the presence of a user in a first detection zone;

an active dispense sensor disposed so as to detect the presence of a user in a second detection zone; and wherein said passive trigger sensor and said active dispense sensor are configured with control circuitry so that, for each said dispense cycle, said passive trigger sensor senses the presence of a user in said first detection zone prior to said active dispense sensor being enabled to initiate a dispense sequence upon detection of the user in the second detection zone.

2. The dispenser as in claim 1, wherein said passive trigger sensor must reset to a base state indicating the absence of a user in the first detection zone before said active dispense sensor is enabled for a subsequent dispense sequence.

3. The dispenser as in claim 1, wherein said control circuitry defines a preset time period between dispense sequences initiated by said active dispense sensor.

4. The dispenser as in claim 3, wherein said passive trigger sensor must rest to a base state indicating the absence of a user in the first detection zone before said time period is measured.

5. The dispenser as in claim 1, wherein said passive trigger sensor comprises a photo sensor that detects changes in ambient light conditions within said first detection zone upon a user entering said first detection zone.

6. The dispenser as in claim 1, wherein said active dispense sensor comprises an Infrared (IR) sensor that detects the presence of a user in said second detection zone.

7. The dispenser as in claim 1, wherein said passive trigger sensor comprises a photo sensor that detects changes in ambient light conditions within said first detection zone upon a user entering said first detection zone, and said active dispense sensor comprises an Infrared (IR) sensor that detects the presence of a user in said second detection zone.

8. The dispenser as in claim 1, wherein said passive trigger sensor is oriented so that said first detection zone is defined adjacent to a front side of said housing, and said active dispense sensor is oriented so that said second detection zone is defined below a bottom surface of said housing.

9. The dispenser as in claim 8, wherein said second detection zone does not extend in a forward direction beyond a vertical plane of a forward most portion of said housing.

10. The dispenser as in claim 9, wherein said housing comprises a dispensing throat in a bottom portion thereof through which the web material is dispensed, said active dispense sensor comprising at least one active transmitter and a receiver oriented within said housing adjacent to said dispensing throat to transmit an active signal in a transmission zone defining said second detection zone below said housing.

11. The dispenser as in claim 10, wherein said active transmitter and receiver are oriented with respect to said dispensing throat such that a sheet of the web material hanging out of said dispensing throat disrupts detection of an object within said detection zone.

12. The dispenser as in claim 11, wherein the active transmitter and receiver are oriented such that the hanging sheet of material passes in front of said transmission zone towards a front side of said housing and prevents reflection of the active signal from an object placed in said detection zone.

13. The dispenser as in claim 1, further comprising an ambient light sensor configured with said control circuitry as a low-light sensor that shifts said dispenser to a reduced power mode in low-light conditions, said passive trigger sensor and said active dispense sensor disabled in the low-light conditions.

14. The dispenser as in claim 13, wherein said ambient light sensor is disposed so as to detect ambient light conditions above said housing.

15. A method of operation for an electronic hands-free paper towel dispenser to dispense a sheet of web material in a dispense cycle, comprising detecting the presence of a user in a first detection zone with a passive sensor and subsequently detecting the presence of the user in a second detection zone with an active sensor wherein, for each dispense cycle, the passive sensor must sense the presence of a user in the first detection zone prior to the active sensor detecting the presence of the user in the second detection zone to initiate a dispense sequence.

16. The method as in claim 15, further comprising resetting the passive sensor to a base state in the absence of a user in the first detection zone before enabling the active sensor for a subsequent dispense sequence.

17. The method as in claim 15, further comprising setting a preset time period between dispense sequences initiated by the active sensor.

18. The method as in claim 17, comprising resetting the passive sensor to a base state indicating the absence of a user in the first detection zone before starting measurement of the time period.

19. The method as in claim 15, comprising detecting the presence of a user in the first detection zone with the passive sensor by detecting changes in ambient light conditions within the first detection zone upon a user entering the first detection zone.

20. The method as in claim 15, comprising detecting the presence of a user in the second detection zone with an active IR transmitter and receiver.

21. The method as in claim 15, comprising defining the first detection zone adjacent to a front side of the dispenser housing, and defining the second detection zone below a bottom surface of the housing.

22. The method as in claim 21, wherein the second detection zone does not extend in a forward direction beyond a vertical plane of a forward most portion of the dispenser housing.

23. The method as in claim 15, further comprising detecting ambient light conditions around the dispenser sensor and enabling the passive and active sensors only upon detecting a threshold value of ambient light.

* * * * *